United States Patent [19]

Mitchener

[11] Patent Number: 4,574,791

[45] Date of Patent: Mar. 11, 1986

[54] MUSCLE-TONING DEVICE

[76] Inventor: Milton J. R. Mitchener, 1305 1/2 N. McCadden Pl., Hollywood, Calif. 90028

[21] Appl. No.: 574,470

[22] Filed: Jan. 27, 1984

[51] Int. Cl.[4] ..... A61F 5/00

[52] U.S. Cl. ..... 128/79; 128/25 R; 128/31; 128/341; 272/93; 272/137

[58] Field of Search ..... 128/25 R, 31, 79, 774, 128/778, 341, 344; 272/116, 135–137

[56] References Cited

U.S. PATENT DOCUMENTS

| | | | |
|---|---|---|---|
| 2,541,520 | 2/1951 | Kegel | 128/778 |
| 3,726,273 | 4/1973 | Cole | 128/778 |
| 3,996,930 | 12/1976 | Sekulich | 128/67 |
| 4,050,449 | 9/1977 | Castellana et al. | 128/778 |
| 4,106,489 | 8/1978 | Martin | 272/137 |
| 4,167,938 | 9/1979 | Remih | 128/778 |

*Primary Examiner*—Richard J. Apley
*Assistant Examiner*—David J. Brown
*Attorney, Agent, or Firm*—Francis X. LoJacono

[57] ABSTRACT

This invention is directed to a muscle-toning device, and more particularly to a device to aid in the strengthening of the pubococcygeus muscle related to the female pelvic structure, so as to overcome and/or prevent various gynecological or urinary problems. The device includes a vaginal insert member connected by either a flexible or stretchable cable to an exteriorly disposed support body which allows the vaginal-insert member to reciprocate within the vaginal cavity when the user thereof rhythmically contracts and relaxes the pubococcygeus muscle.

9 Claims, 5 Drawing Figures

MUSCLE-TONING DEVICE

BACKGROUND OF THE INVENTION

This invention relates generally to a muscle-toning device, and more particularly to a device for toning the female pelvic muscle, the anatomical name for which is the pubococcygeus muscle, or PC muscle for short.

In the art of medicine, physicians have noted that female patients encounter gynecological or urinary problems, as well as sexual dysfunction, due to a weakness in this pelvic muscle.

Under certain conditions, surgery has been generally employed to correct the related medical problems of patients. Even after surgery, however, the chronic weakness in this muscle would allow the initial problems to recur in a number of patients within a period of approximately six months.

Therefore, special exercises have been employed whereby the pubococcygeus muscle (hereinafter referred to as the PC muscle) can recover its normal function after years of disuse —sometimes in only a matter of weeks. These exercises have been found to be especially beneficial for women suffering from urinary-stress incontinence.

These prescribed exercises consist of the simple push-/pull (contracting) type movement of the PC muscle. However, many women do not understand this muscle, nor can they specifically locate it to control its movement. Thus, there is a need for a muscle-toning device as herein disclosed. To the applicant's knowledge, there is no such device available to assist women in exercising their PC muscle.

The only device now available as an attempt to correct the problem of a weak PC muscle is one devised by a gynecologist, Arnold Kegel, M. D., which is known as a perineometer. With this device, one can observe the strength of the contractions of a patient's PC muscle, so as to determine which exercise program to be prescribed. The perineometer is a hollow rubber cone supported on a form so that it can be inserted into the region of the vagina which is surrounded by the PC muscle. However, this device is simply a gauge and is not designed to assist in exercising the muscle itself.

SUMMARY OF THE INVENTION

The present invention has for an important object to provide a muscle-toning device for females specifically designed to establish a simple but positive means for exercising the pelvic pubococcygeus (PC) muscle that supports the internal and external female genital organs, and prevents them from sagging.

Another object of the present invention is to provide an exercising device of this character that is readily inserted and received in the vagina, allowing the user thereof to distinguish the proper movement of the PC muscle with respect to the other associated pelvic muscles.

Still another object of the present invention is to provide a device of this character that aids in overcoming various gynecological and urinary problems such as urinary-stress incontinence, that maintains lubrication in post-menopausal women, and that stimulates better blood circulation throughout the female genital organs.

A further object of the invention is to provide a device of this character that includes a vaginal-insert member having a somewhat-elongated, pear-shaped configuration, so as to be readily engaged by the PC muscle, the insert member being interconnected by a flexible connector to an outer support housing for a vaginal stimulator.

A still further object of the invention is to provide a muscle-toning device that is easily serviced, cleaned and maintained to establish suitable hygenic conditions necessary for its continuous use.

It is a further object of the invention to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Novel features and advantages of the present invention in addition to those mentioned above will become apparent to those skilled in the art from a reading of the following detailed description in conjunction with the accompanying drawings, wherein.

DESCRIPTION OF THE PREFERRED EMBODIMENT

Figure 1:
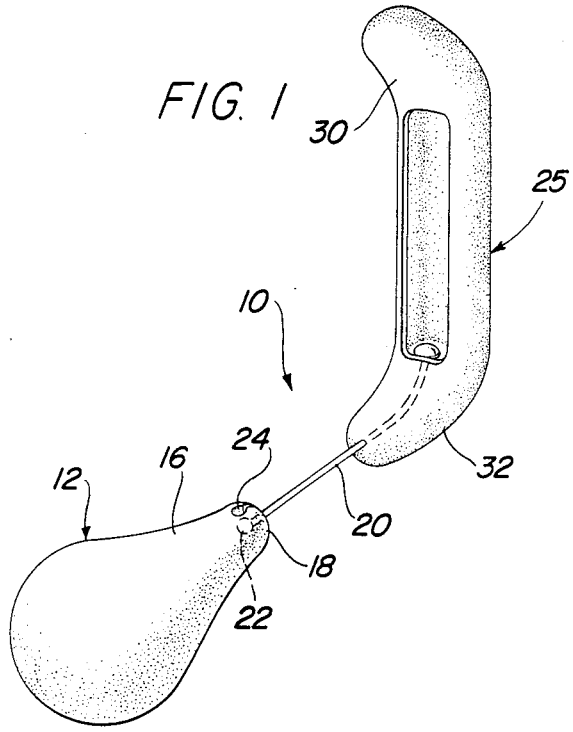
FIG. 1 is a perspective view of the present invention, a muscle-toning device, the elements thereof being shown in the position when in use.
Figure 2:
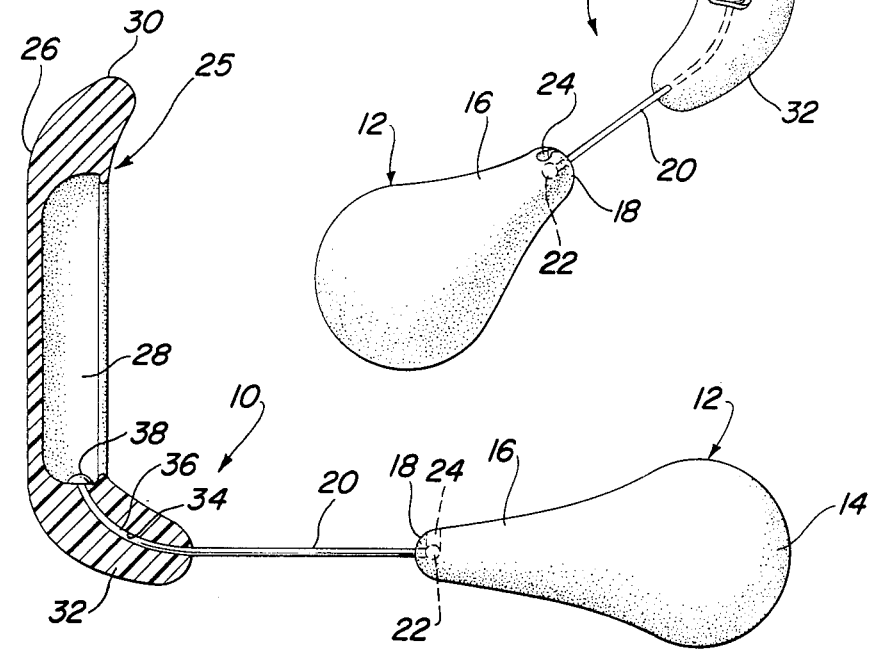
FIG. 2 is a side-elevational view thereof with the outer vaginal-support member shown in cross section, and interconnected to the vaginal-insert member by an elastic band or cable.

Referring more particularly to FIGS. 1 and 2, there is shown a muscle-toning device, generally indicated at 10. This invention is designed to aid in the strengthening of the female pubococcygeus (PC) muscle. Although interwoven with and surrounded by four sets of other pelvic muscles, this muscle is the master muscle of the pelvis. The PC muscle is basically a sphincter muscle that passes through the middle third of the vagina and runs in a circular band, with ring-like ridges forming a part of the urethra and anus. When this muscle is completely healthy and fit, it is taut and held in a substantially straight line.

As mentioned heretofore, in order to strengthen the PC muscle, exercises have been developed for patients before undergoing gynecological and urinary surgery. Such exercises have also been very effective post-operatively, and now are sometimes prescribed as alternatives to surgery. Accordingly, the present invention has been developed to aid the patient or individual in exercising this particular muscle and the associated pelvic muscles.

The muscle-toning device 10 comprises a vaginal-insert member 12 which includes a bulbous body 14 having an extended neck portion 16, defining a substantially pear-shaped configuration. It is contemplated that vaginal-insert member 12 be formed from a latex material, or other soft flexible material suitably acceptable for internal body use, as herein described. Insert member 12 may be constructed in either a solid or a hollow bulb-like form having an approximate overall length of four inches. Thus, the length and pear-shaped configuration of the insert member is readily adapted to be received and fitted into various sizes of vaginal cavities without discomfort to the patient or user thereof. The distal end 18 of neck portion 16 is thus positioned adjacent the vaginal opening, or is allowed to protrude through the opening, whichever is particularly suitable to the individual user thereof.

Removably attached to the distal end 18 of neck portion 16 is an elastic band or cable 20 which is provided at one end with an attaching means, such as a ball member 22, which is adapted to be inserted into slot 24 formed in end 18 of the neck portion 16. The opposite end of band 20 is attached to a support means, generally indicated at 25, which defines an external body member 26. The body member is formed as an elongated finger having a corresponding elongated cavity 28 formed therein which is interposed between an upper, inwardly bent, solid, end member 30, and a lower, inwardly bent, solid member 32. This configuration is adapted to generally conform to the basic form of the external orifice of the vagina, known as the vulva. It is particularly arranged to be positioned and supported within the vulva between the outer folds of tissue referred to as labia majora.

Accordingly, the lower bent member 32 is formed having a passage or slot 34 which is designed to receive the opposite end 36 of elastic band 20. The band is secured to external body member 26 by means of an enlarged end member 38.

Once the vaginal-insert member is positioned in the vaginal cavity and the external body member is also properly positioned, the patient or user will at that time induce rhythmic contractions of the pelvic muscles which in turn will cause the PC muscle to react similarly, thus contracting about the pear-shaped insert member.

Most women can not distinguish between the movement of the PC muscle and other surrounding muscles when trying to induce contractions. Sometimes, the lower abdominal muscles are inadvertently contracted, thus providing no effect on the PC muscle. Hence, when the correct muscle contractions are made, the vaginal-insert body member 12 will be pulled rearwardly and deeper into the vaginal cavity as the surrounding PC and related muscles engage the pear-shaped body.

When the muscles are relaxed, the insert body member 12 will be returned to the forward position by the pulling force of the elastic band or cable 20. During the back-and-forth recipricating movement of vaginal insert 12, the exteriorly disposed support body 26 is anchored within the area of the vulva, thereby providing a substantially fixed member to allow elastic band 20 to stretch as insert member 12 is moved rearwardly by the contracting muscles of the individual.

Thus, it can be seen that after a short period of time one can become well adept at controlling the movement of the PC muscle by continuous use of the present invention.

Figure 4:
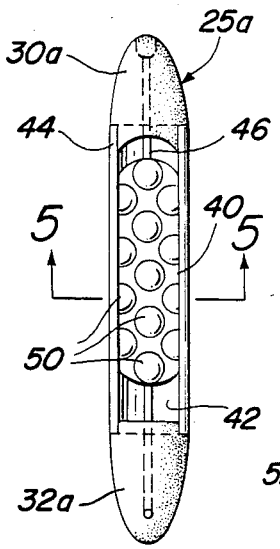
FIG. 4 is a front view of the outer vaginal-support member taken substantially along line 4—4 of FIG. 3.
Figure 3:
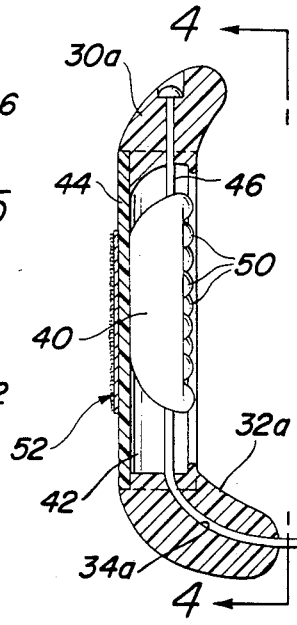
FIG. 3 is a side-elevational view of an alternative arrangement similar to that in FIG. 2, with the vaginal-support member in cross section, and including a stimulator pad therein, the pad being connected to the vaginal-insert member.
Figure 5:
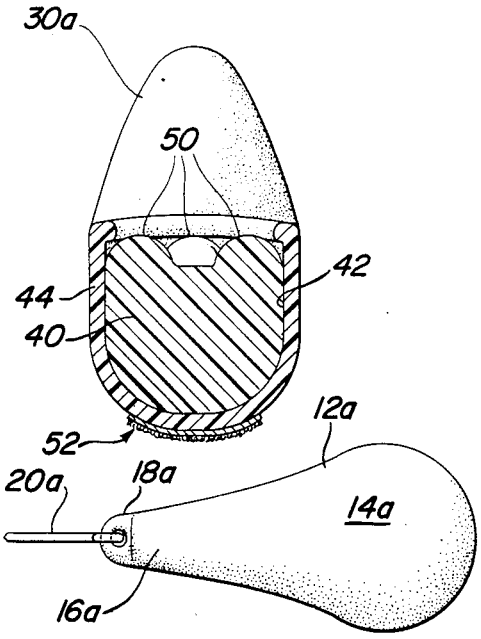
FIG. 5 is an enlarged cross-sectional view taken along line 5—5 of FIG. 4.

Referring now to the second embodiment of the present invention, which is illustrated in FIGS. 3, 4 and 5, there is shown a similar pear-shaped vaginal-insert member **12*a* having a bulbous body portion 14*a*, and an extended neck portion 16*a*. However, in this arrangement, cable or band 20*a* is formed as a fixed connector. That is, it is flexible but is not elastic for stretching. Cable 20*a* has one end secured to the distal end 18*a* of neck portion 16*a*, and is slidably disposed in passage or bore 34*a* formed in the lower end member 32*a* of support means 25*a*. The opposite end of cable 20*a* is attached to a stimulator means defined by pad 40 which is slidably mounted in the elongated cavity 42 defined by shell 44, the shell having each end thereof capped by the respective end members 30*a* and 32*a*. Thus, support means 25*a* in this arrangement is formed from three separate plastic parts 30*a*, 32*a* and 44**.

The upper end of pad 40 is provided with an elastic band 46 which is attached to upper end member **30*a*. Accordingly, as vaginal insert 14*a* is moved back and forth in the vaginal cavity by the contracting and relaxing of the PC muscle, pad 40 will be caused to reciprocate within cavity 42 of the support means. The movement of pad 40 will also cause a massaging or stimulating action, so as to create an increase of vascular activity within the general area of the vulva. Stimulator pad 40 is shown having a plurality of massaging protruberances 50**. However, various other shaped surfaces are contemplated as might be desired.

Mounted to shell 44 is a fastening means 52 which is adapted to be secured to adjacent clothing worn by the individual. This fastening means is defined by a cloth-type material such as "Velcro", which is the trademark for a well-known fastener.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A muscle-toning device comprising:

a vaginal-insert member adapted to be disposed within the female vaginal cavity, so as to be subjected to the contracting and relaxing of the surrounding muscles thereof;

said vaginal-insert member including an enlarged, bulbous, body member having an elongated neck portion, wherein said bulbous body and said neck portion thereof define a pear-shaped configuration;

a support means interconnected to said vaginal-insert member, and adapted to be disposed adjacent the exterior of said vaginal cavity in a substantially fixed manner; and a stretchable connecting means interconnecting said vaginal-insert body with said support means, whereby said vaginal-insert member is adapted to freely reciprocate within said vaginal cavity, without affecting movement of said support means;

wherein said support means comprises an elongated body member, one end thereof being attached to said stretchable connecting means.

2. A muscle-toning device as recited in claim 1, wherein said stretchable connecting means is formed by an elastic band interconnecting said elongated body of said support means to said vaginal-insert member.

3. A muscle-toning device as recited in claim 1, wherein said elongated body of said support means includes a longitudinal cavity disposed therein.

4. A muscle-toning device as recited in claim 2, wherein said elastic band is removably attached to said vaginal-insert member, said insert member having a slot formed in the distal end thereof to receive an enlarged ball member formed on one end of said elastic band.

5. A muscle-toning device as recited in claim 3, wherein said device includes a stimulator means slidably disposed in said cavity of said support means.

6. A muscle-toning device as recited in claim 5, wherein said stretchable connecting means comprises:

a flexible cable connected at one end to the distal end of said vaginal-insert member, and at the opposite end to said stimulator means; and an elastic band attached to the opposite end of said stimulator means and to said elongated body of said support means, whereby said stimulator means is slidably moved within said cavity of said support means as said vaginal insert is moved within said vaginal cavity by the manipulation of said muscles thereof.

7. A muscle-toning device as recited in claim 6, wherein said stimulator means comprises a pad formed to fit within said cavity of said elongated body.

8. A muscle-toning device as recited in claim 7, wherein said elongated body of said support means comprises:

an elongated shell member formed to define said elongated cavity;

a lower end member adapted to receive said cable therethrough; and an upper end member adapted to have said elastic band mounted thereto.

9. A muscle-toning device as recited in claim 8, wherein the support means includes attaching means mounted on said body thereof for engagement with adjacent clothing worn by the user thereof.

* * * * *